US006694862B1

(12) United States Patent
Beckley et al.

(10) Patent No.: US 6,694,862 B1
(45) Date of Patent: Feb. 24, 2004

(54) ACCESSIBLE HAND PUMP

(75) Inventors: Robert G. Beckley, Missoula, MT (US); Charles W. Harding, Florence, MT (US); Tyler V. Kuhn, Bozeman, MT (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 0 days.

(21) Appl. No.: 10/189,857

(22) Filed: Jul. 3, 2002

(51) Int. Cl.[7] ..... F15B 15/24; F16H 21/18
(52) U.S. Cl. ..... 92/13.41; 74/50
(58) Field of Search ..... 92/13.4, 13.41; 74/44, 50, 55

(56) References Cited

U.S. PATENT DOCUMENTS 363,840 A * 5/1887 Miller et al. ..... 74/50
672,320 A * 4/1901 Margadant ..... 74/50
853,707 A * 5/1907 Ford ..... 74/50
4,475,872 A 10/1984 Foughty
4,603,593 A 8/1986 Clegg
5,456,159 A 10/1995 Brackett
5,772,405 A * 6/1998 Eller ..... 74/44

OTHER PUBLICATIONS

Simple Pump Company, [retrieved on Mar. 19, 2002] Retrieved from the Internet: <URL: www.simplepump.com/motorized.html.

* cited by examiner

*Primary Examiner*—Thomas E. Lazo
(74) *Attorney, Agent, or Firm*—John D. Fado; Curtis P. Ribando

(57) ABSTRACT

A hand-operated pump, readily accessible and useable by people with disabilities, complies with the specifications set forth in the American Disabilities Act. The reciprocating pump provides for counterbalance-assisted rotary motion input by the user, is simple in design, inexpensive to produce, operates reliably in the field, and requires very little maintenance. The pump is suitable for use in remote areas, such as on ranches, farms and in the National Forest System campgrounds and recreational areas.

21 Claims, 2 Drawing Sheets

ACCESSIBLE HAND PUMP

BACKGROUND OF THE INVENTION

1. Field of the Invention

This invention relates to a hand-operated pump that is readily accessible and useable by people with disabilities. This pump complies with the American Disabilities Act (ADA) and allows persons with disabilities access to potable water by applying a maximum force of 5 pounds (22.2 newtons) to the pumping mechanism. It would find application as an installment at camp sites, undeveloped vacation property, recreational fields, parks, farms, ranches and industrial settings. It would be especially useful in the National Forest System campgrounds and recreational areas.

2. Description of the Prior Art

Standard farm and campground hand pumps comprise a reciprocating positive displacement piston encased in a cylinder located in an underground water supply. The piston is driven by a pump rod that reciprocates vertically within a water supply line. The reciprocal motion of the pump rod is provided by a handle that the user "pumps" in an up-and-down motion. Typically, pumps of this design require good strength and body leverage to operate effectively.

Various approaches have been taken in an effort to substitute a rotary motion for the more conventional up-and-down pumping motion of hand pumps. Foughty (U.S. Pat. No. 4,475,872) relates to a progressing cavity pump, wherein a screw-like helical rotor turns eccentrically within a helical stator. Input power is supplied by the user to a rotary, horizontal shaft and is then transferred to a vertical pump drive shaft by means of a gear box. A combination of gears and clutches allows the user to rotate the power input shaft in either direction without damage to the pump.

The Simple™ Pump Company manufactures a motorized pump that transfers the rotary motion of an electric motor to a reciprocating up-and-down motion of the pump rod by means of a Scotch yoke. An adjustable pin arm driven by the motor permits selection of a predetermined pump stroke and various head pressures.

There are variations of the Scotch yoke such as the synchronized Scotch yoke taught by Clegg (U.S. Pat. No. 4,603,593). This device employs curved cam tracks resembling in shape a reclining figure eight. Each degree of revolution of the crank pin produces uniform displacement of the reciprocating member, and power is distributed evenly throughout the stroke.

Other mechanisms for converting rotary motion to reciprocal motion and vice versa are known in the art. For example, Brackett (U.S. Pat. No. 5,456,159) discloses a conjugate drive motion translator comprising a system of interacting members including a reciprocating linearly moving shuttle, a pair of opposing conjugate bearings, a pair of conjugate drivers rotatably mounted to the crankpin of crankshaft with the axis of crankshaft rotation perpendicular to the linear path of the shuttle.

In view of various complexities associated with the aforementioned devices, none fully meets the needs of many individuals with disabilities requiring access to well water in undeveloped areas.

SUMMARY OF THE INVENTION

We have now discovered a reliable hand-operated pump, readily accessible and useable by people with disabilities, for use in campgrounds and other remote areas where electricity is not available. The design of the pump obviates the undue force and lengthy stroke of conventional reciprocating handle-type hand pumps, and complies with the specifications set forth in the ADA.

In accordance with this discovery, it is an object of this invention to provide a hand pump that can be operated with one hand and requires the user to apply no more than 5 pounds (22.2 newtons) of force to the pumping mechanism within a vertical range of 12 inches (30 cm) between 28 and 40 inches (0.7–1 m) from the ground.

It is a further object of this invention to provide a hand pump that fully meets the specifications of the ADA.

It is also an object of the invention to provide a hand pump that is simple in design, inexpensive to produce, operates reliably in the field, and requires very little maintenance.

Another object of the invention is to convert user-applied rotary motion to a reciprocating pump rod.

Other objects and advantages of this invention will become readily apparent from the ensuing description.

DETAILED DESCRIPTION

The accessible hand pump of the invention comprises two subassemblies: the rotary motion subassembly for power input by the user; and the reciprocating vertical motion subassembly for lifting water from the water supply. Transfer of rotary motion from the first subassembly to reciprocating motion from the second subassembly is accomplished by means of a Scotch yoke mechanism or the like.

Figure 1:
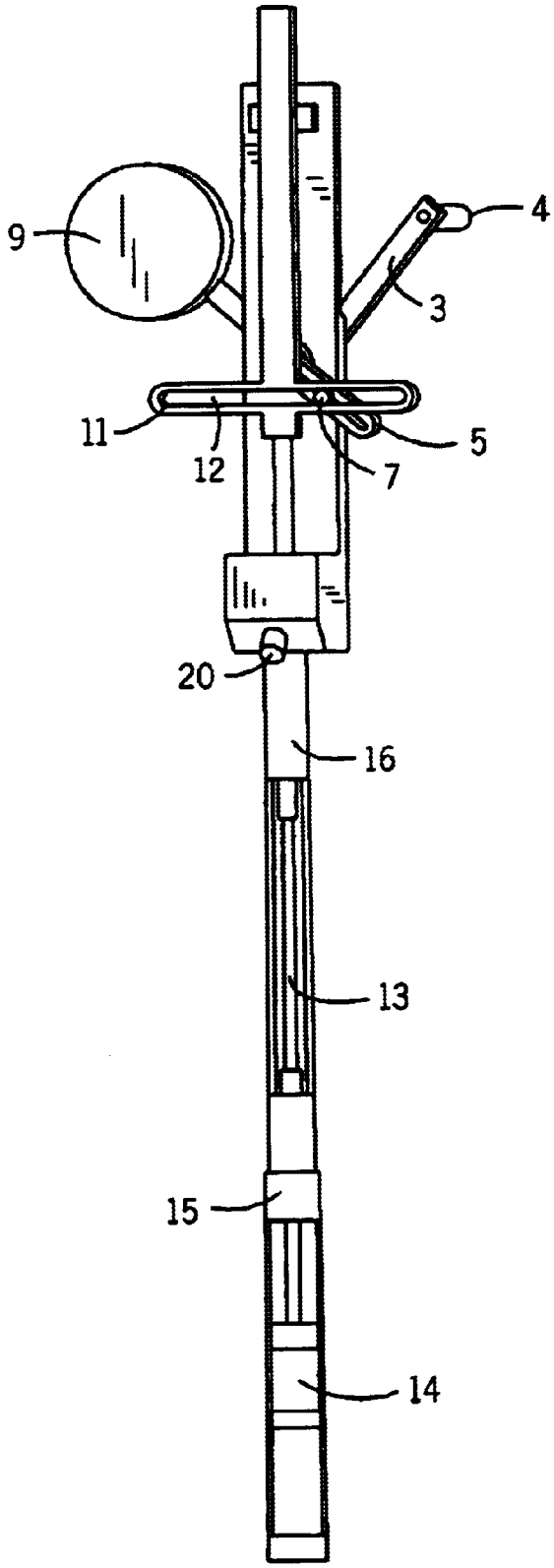
FIG. 1 is a perspective view of the accessible hand pump of the invention.
Figure 2:
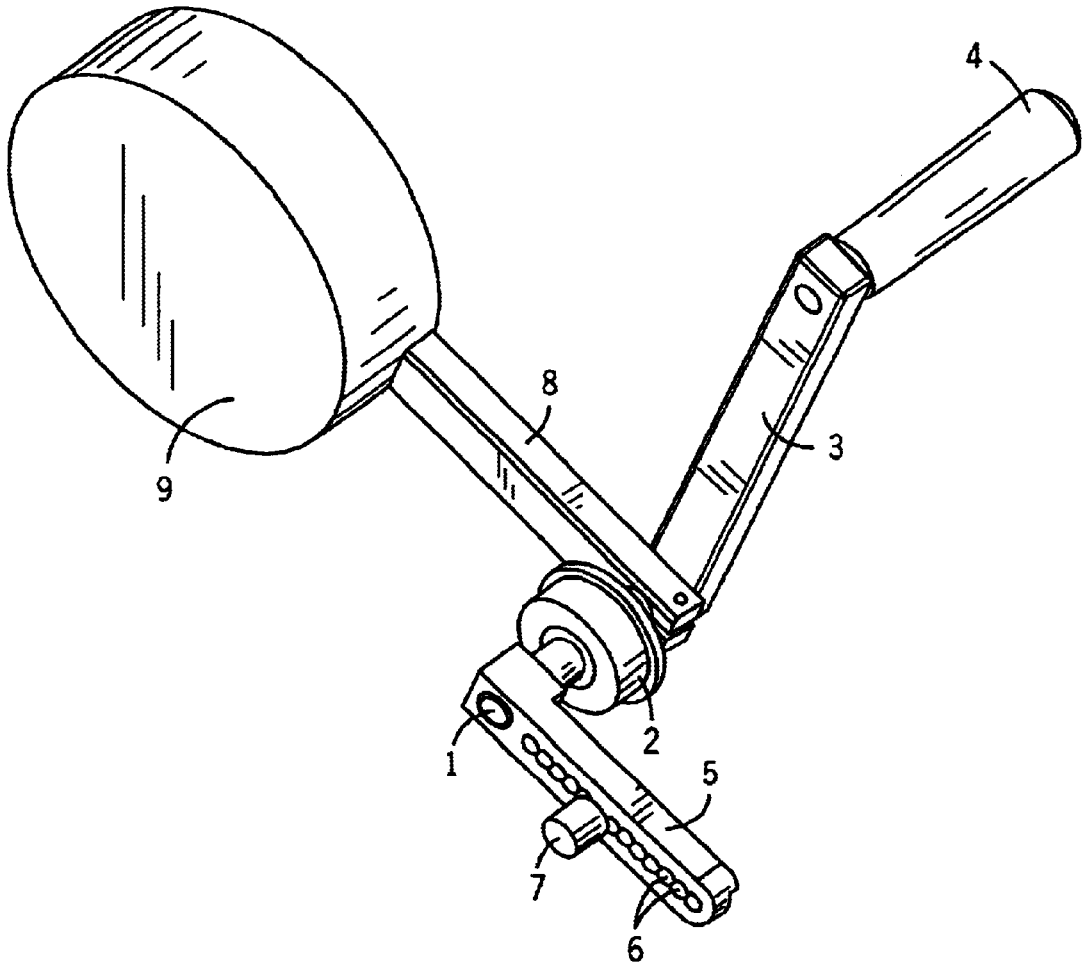
FIG. 2 is a perspective view of the rotary motion subassembly of the invention.

The rotary motion subassembly is best illustrated in FIG. 2. It comprises a rotatable shaft 1 journaled to the pump framework (not shown) by means of bearing 2. Crank arm 3 is rigidly affixed to shaft 1 and is provided on its distal end with a pivotally mounted handle 4. Also rigidly secured to shaft 1 is pin arm 5 having one or more positioning points 6 for attachment of engagement member 7. The engagement member 7 may be a pin (such as a rod), a roller bearing, sleeve bearing or the like, such that it freely travels in slot 12 of T-bar 11 as described further below. The positioning points 6 may be holes, slots, depressions, or the like, or a combination thereof that serve to secure the engagement member 7 onto pin arm 5 at a predetermined distance from the center of shaft 1. Providing the pin arm 5 with a plurality of positioning points 6 permits adjustment in the field of both the vertical stroke of pump rod 13 (FIG. 1) and the requisite torque for rotating crank arm 3 as described in further detail below. The position of crank arm 3 relative to the pin arm 5 is arbitrary. Also rigidly affixed to shaft 1 and/or crank arm 3 is a counterbalance comprising counterbalance arm 8 and counterbalance weight 9. The moment applied by the counterbalance to shaft 1 serves to significantly offset the resistance applied to shaft 1 by the vertically reciprocating subassembly and the column of water being lifted. For the optimal assistance, counterbalance arm 8 should be parallel to the ground when the resistance from the water column is at a maximum. In the embodiment depicted in FIG. 1, counterbalance arm 8 is offset approximately 180° (180°±10°) from the pin arm 5. By virtue of this offset, the counterbalance rotates with shaft 1 in a manner that its vertical displacement is approximately 180° out of phase with the vertical displacement of piston 14 (described below). Counterbalance arm 8 is also offset from crank arm 3 about 90° (±15°) so that a user in a wheelchair approaching the pump in a manner that the wheels of the chair are parallel to the plane of rotation of the crank arm rotation will be able to apply optimal leverage to the handle at the points of the pump cycle (when the counterbalance arm is parallel to the ground) where the torque is the greatest.

The reciprocating vertical motion subassembly for lifting water from the water supply is depicted in FIG. 1. The engagement member 7 of pin arm 5 engages slot 12 in T-bar 11. Together, the pin arm 5, engagement member 7, and T-bar 11 with slot 12 comprise a Scotch yoke. The length of slot 12 must be at least equal to the horizontal displacement of member 7 during each revolution of crank arm 3. T-bar 11 is affixed to pump rod 13 so that the two members vertically reciprocate in tandem. The pump rod drives piston 14 encased in cylinder 15. Cylinder 15 is submerged below the water line of the water supply.

In the embodiment depicted in FIG. 1, slot 12 is perpendicular to the reciprocating line of travel of pump rod 13 and parallel to the ground. Alternatively, the slot can be oriented at an angle of up to about 45° relative to the ground. In that case, the angle of pin arm 5 relative to the counterbalance arm 8 should be altered accordingly in order to obtain the maximum effect of the counterbalance at the point of highest torque demand. That is, when counterbalance arm 8 is parallel to the ground, then pin arm 5 should be parallel or approximately parallel to slot 12.

On the upstroke of the piston 14, the column of water above the piston is forced up supply line 16 and out the water spout 20. On the downstroke of the piston, water in the cylinder enters the piston and the cylinder head space above the piston through a ball valve or the like (not shown) and replenishes the water column above the piston. Though the conventional Scotch yoke depicted in FIG. 1 represents a preferred embodiment of the invention, it is understood that other mechanisms for converting rotary motion to linear motion, such as the synchronized Scotch yoke of U.S. Pat. No. 4,603,593, could be substituted therefor.

As previously mentioned, compliance with ADA specifications imposes limitations on the force applied to the handle 4 and on the maximum and minimum height of the handle above the ground. These limitations dictate a maximum length of approximately 6" (15 cm) for crank arm 3, and a force of 5 lb. (22 N). These constraints limit the amount of input torque to 30 inch-pounds (3.4 meter-newtons). The input torque must be sufficient to counteract the combined resistance resulting from the weight of the column of water above the piston, the weight of the vertical subassembly, and any internal frictional forces. Of course the deeper the well, the heavier the column of water being lifted. Given, that the maximum input torque is fixed, the pump stroke must be adjusted to accommodate the well depth. For shallow wells, the vertical stroke of the Scotch yoke can be maximized by setting the engagement member 7 at the most distal point on pin arm 5 relative to shaft 1. For a deeper well, the vertical stroke can be shortened by positioning the bearing closer to shaft 1. The effect of shortening the stroke would be to reduce the resistance imparted by the column of water and also the flow rate (volume of water per revolution of crank arm 3.) The maximum operable well depth for use of the invention is approximately 60' (18 m).

A critical component of this invention is the use and appropriate positioning of a counterbalance. The total weight of the counterbalance arm 8 and counterbalance weight 9 are selected so that the input torque required to lift the counterbalance and overcome any internal resistance of the pump mechanism does not exceed a predetermined amount. As discussed above, that predetermined amount as related to ADA compliance is 30 inch-pounds (3.4 m-N). The contribution to this torque provided by the counterweight should be in the range of about 24–30 inch-pounds (2.7–3.4 m-N), which translates to a counterweight mass of 4–5 pounds (1.8–2.3 kg) centered 6" (15 cm) from shaft 1. Assuming, for example, approximately 3 inch-pounds (3 m-N) of internal resistance, then the resistance imparted by the counterbalance should not exceed 27 inch-pounds (3 m-N). By virtue of the counterbalance being approximately 180° offset with respect to the pin arm 5, it serves to offset approximately half of the torque needed to lift the column of water. The counterbalance therefore has the effect of reducing, by approximately half, the force that the user must apply to the pump handle 4. Thus, an effective torque of approximately 54 inch-pounds (6.1 m-N) can be applied to the pin arm 5 during the upstroke, with the user still applying only 5 pounds of force to the crank arm 3. At the peak of the upstroke, the resistance imparted by the water column drops to near zero, and the input force is directed to raising the counterbalance to the top of its stroke. In a preferred embodiment of the invention, the counterbalance and Scotch yoke are enclosed in protective housing (not shown).

Another critical aspect of the counterbalance is that it imparts resistant on the downstroke (of the piston), thereby ensuring a nearly consistent input force during both the piston's upstroke and downstroke and throughout a complete rotary cycle of the crank. The smoothing effect that the counterbalance has on the rotary cycle is important to the facile use of the pump by individuals having limited strength and/or range of motion of a limb used to operate the pump.

In the simplest embodiment of the invention, the counterbalance weight 9 is rigidly affixed to the arm 8. However, the weight may also be slidably affixed to the arm or otherwise attached so that it can be secured at a variable distance from the center of shaft 1. This arrangement would permit adjusting the contribution of the counterweight as required to accommodate the amount of internal pump resistance or other factors related to the specific pump installation.

It is understood that modifications and variations may be made to the described invention without departing from the spirit and scope of the invention as defined by the claims.

We claim:

1. A hand-operated pump for operation by a user below a maximum input force threshold, the pump comprising a vertically reciprocating piston, a crank for generating rotary motion to a shaft, means for converting the rotary motion of said shaft to reciprocating motion, means for transferring the reciprocating motion to said piston, a counterbalance that rotates with said shaft in a manner that the vertical displacement of said counterbalance is approximately 180° out of phase with the vertical displacement of said piston and has a maximum weight such that the required force for generating said rotary motion is less than said maximum input force threshold, and wherein said counterbalance comprises a counterbalance arm that is offset relative to said crank about 90°.

2. The hand-operated pump of claim 1, wherein said means for converting said rotary motion to said reciprocating motion is a Scotch yoke comprising a T-bar affixed to said means for transferring the reciprocating motion to said piston, a substantially horizontal slot in said T-bar, a pin arm affixed to said shaft, and an engagement member affixed to said pin arm and engaged in said slot.

3. The hand-operated pump of claim 2 wherein said engagement member is a bearing.

4. The hand-operated pump of claim 3, wherein said bearing is a roller bearing or a sleeve bearing.

5. The hand-operated pump of claim 1, wherein the maximum input force threshold is 5 pounds.

6. The hand-operated pump of claim 1 characterized by a maximum input torque of 30 inch pounds.

7. The hand-operated pump of claim 1, wherein said counterbalance is 180°±10° out of phase with the vertical displacement of said piston.

8. A hand-operated pump for operation by a user below a maximum input force threshold, the pump comprising a vertically reciprocating piston, a crank for generating rotary motion to a shaft, means for converting the rotary motion of said shaft to reciprocating motion, means for transferring the reciprocating motion to said piston, a counterbalance that rotates with said shaft in a manner that the vertical displacement of said counterbalance is approximately 180° out of phase with the vertical displacement of said piston and has a maximum weight such that the required force for generating said rotary motion is less than said maximum input force threshold, wherein said means for converting said rotary motion to said reciprocating motion is a Scotch yoke comprising a T-bar affixed to said means for transferring the reciprocating motion to said piston, a substantially horizontal slot in said T-bar, a pin arm affixed to said shaft, and an engagement member affixed to said pin arm and engaged in said slot, and wherein said pin arm has a plurality of positioning points for securing said engagement member thereto and adjusting the stroke of said piston.

9. The hand-operated pump of claim 8 wherein said engagement member is a bearing.

10. The hand-operated pump of claim 9, wherein said bearing is a roller bearing or a sleeve bearing.

11. The hand-operated pump of claim 8, wherein the maximum input force threshold is 5 pounds and the maximum input torque is 30 inch pounds.

12. The hand-operated pump of claim 8, wherein said counterbalance comprises a counterbalance arm and a counterbalance weight affixed to said arm.

13. The hand-operated pump of claim 12, wherein said counterbalance weight is adjustably positionable along the length of the counterbalance arm.

14. The hand-operated pump of claim 8, wherein said counterbalance is 180°±10° out of phase with the vertical displacement of said piston.

15. A hand-operated pump for operation by a user below a maximum input force threshold, the pump comprising a vertically reciprocating piston, a crank for generating rotary motion to a shaft, means for converting the rotary motion of said shaft to reciprocating motion, means for transferring the reciprocating motion to said piston, a counterbalance that rotates with said shaft in a manner that the vertical displacement of said counterbalance is approximately 180° out of phase with the vertical displacement of said piston and has a maximum weight such that the required force for generating said rotary motion is less than said maximum input force threshold, wherein said counterbalance comprises a counterbalance arm and a counterbalance weight affixed to said arm and adjustably positionable along the length of the counterbalance arm.

16. The hand-operated pump of claim 15, wherein said means for converting said rotary motion to said reciprocating motion is a Scotch yoke comprising a T-bar affixed to said means for transferring the reciprocating motion to said piston, a substantially horizontal slot in said T-bar, a pin arm affixed to said shaft, and an engagement member affixed to said pin arm and engaged in said slot.

17. The hand-operated pump of claim 16, wherein said pin arm has a plurality of positioning points for securing said engagement member thereto and adjusting the stroke of said piston.

18. The hand-operated pump of claim 16, wherein said engagement member is a bearing.

19. The hand-operated pump of claim 18, wherein said bearing is a roller bearing or a sleeve bearing.

20. The hand-operated pump of claim 15, wherein the maximum input force threshold is 5 pounds and the maximum input torque is 30 inch pounds.

21. The hand-operated pump of claim 15, wherein said counterbalance is 180°±10° out of phase with the vertical displacement of said piston.

* * * * *